US011596989B2

(12) United States Patent
Seitz et al.

(10) Patent No.: US 11,596,989 B2
(45) Date of Patent: Mar. 7, 2023

(54) METHOD AND COMPUTER PROGRAM PRODUCT FOR SETTING THE BENDING OF AT LEAST ONE STRAIGHTENING ROLLER OF A ROLLER STRAIGHTENING MACHINE

(71) Applicant: Schuler Pressen GmbH, Hessdorf (DE)

(72) Inventors: Alexander Seitz, Erlangen (DE); Jan-Peter Grosse, Moehrendorf (DE)

(73) Assignee: SCHULER PRESSEN GMBH, Hessdorf (DE)

( * ) Notice: Subject to any disclaimer, the term of this patent is extended or adjusted under 35 U.S.C. 154(b) by 0 days.

(21) Appl. No.: 16/756,221

(22) PCT Filed: Oct. 16, 2018

(86) PCT No.: PCT/EP2018/078222

§ 371 (c)(1),
(2) Date: Apr. 15, 2020

(87) PCT Pub. No.: WO2019/076886

PCT Pub. Date: Apr. 25, 2019

(65) Prior Publication Data

US 2021/0053097 A1 Feb. 25, 2021

(30) Foreign Application Priority Data

Oct. 16, 2017 (DE) ..... 10 2017 124 027.6

(51) Int. Cl.
*B21B 31/16* (2006.01)
*B21D 1/02* (2006.01)
(Continued)

(52) U.S. Cl.
CPC ..... *B21B 31/16* (2013.01); *B21D 1/02* (2013.01); *B21B 2015/0071* (2013.01); *B21D 5/14* (2013.01)

(58) Field of Classification Search
CPC .. B21D 1/02; B21D 31/30; B21D 2015/0071; B21D 38/10; B21D 38/105; B21B 2269/00–10; B21B 2265/12
(Continued)

(56) References Cited

U.S. PATENT DOCUMENTS 3,587,265 A * 6/1971 Silivotti ..... B21B 37/32 72/10.4
4,612,792 A * 9/1986 De Bondt ..... D07B 1/0626 72/183
(Continued)

FOREIGN PATENT DOCUMENTS

DE 3331335 * 3/1985
DE 696 12 225 T2 10/2001
(Continued)

OTHER PUBLICATIONS

EP2666560 Luedecke, et alia (Nov. 27, 2013) (MT) (annotated) (Year: 2013).*
(Continued)

*Primary Examiner* — Adam J Eiseman
*Assistant Examiner* — Fred C Hammers
(74) *Attorney, Agent, or Firm* — Manabu Kanesaka

(57) ABSTRACT

In a method for setting bending of at least one straightening roller in a roller straightening machine, the straightening roller is supported by a plurality of supporting roller devices arranged beside one another in the axial direction, wherein each supporting roller device can be adjusted by an actuating device such that stresses are produced in the straightening roller. To control the actuating device, a control system is provided, by which the adjustment of the supporting roller device can be set manually. Limiting values (vMA, vMI) with respect to the stresses produced in the straightening roller are stored in the control system. In the event of
(Continued)

adjustment of one of the supporting roller devices, maxima (MA) and minima (MI) of the stresses produced in the straightening roller are calculated and it is checked whether the maxima (MA) and minima (MI) lie within the limiting values (vMA, vMI).

9 Claims, 19 Drawing Sheets

(51) Int. Cl.
*B21B 15/00* (2006.01)
*B21D 5/14* (2006.01)

(58) Field of Classification Search
USPC .... 72/10.7, 160, 163, 164, 165; 73/788, 838
See application file for complete search history.

(56) References Cited

U.S. PATENT DOCUMENTS 4,881,392 A * 11/1989 Thompson ..... B21D 1/02
72/164
5,408,855 A * 4/1995 Michaud ..... G01N 3/068
492/38
2013/0327109 A1 12/2013 Abe

FOREIGN PATENT DOCUMENTS

| | | | | | |
|---|---|---|---|---|---|
| EP | 0 035 009 | A1 | | 9/1981 | |
| EP | 0 182 062 | A2 | | 5/1986 | |
| EP | 0 570 770 | A1 | | 11/1993 | |
| EP | 1 673 181 | A1 | | 6/2006 | |
| EP | 2 666 560 | A1 | | 11/2013 | |
| EP | 2666560 | | * | 11/2013 | |
| EP | 2666560 | A1 | * | 11/2013 | ..... B21D 1/02 |
| JP | H11-123457 | A | | 5/1999 | |
| WO | WO-2008049796 | A1 | * | 5/2008 | ..... B21D 5/0272 |

OTHER PUBLICATIONS

DE3331335 Hausen (Mar. 14, 1985) orig and MT (Year: 1985).*
PCT/ISA/210, "International Search Report for International Application No. PCT/EP2018/078222," dated Jan. 23, 2019.

* cited by examiner

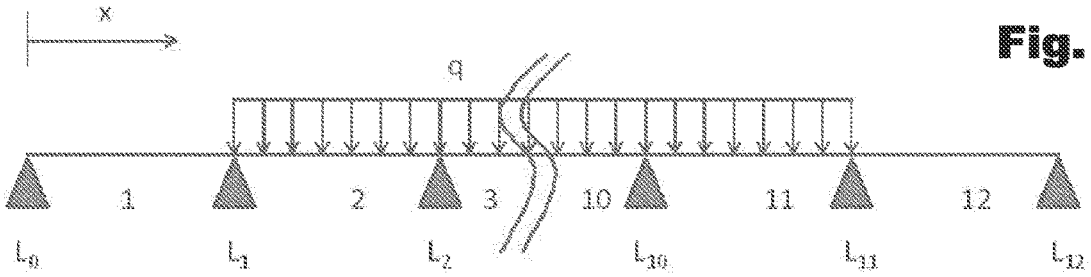

Fig. 8-1

Derivation

A: Linear equation for tilt by adjustment of the support

Bending line $$w_A(x) = \frac{y_1 - y_2}{x_1 - x_2} \cdot x + \frac{x_1 \cdot y_2 - x_2 \cdot y_1}{x_1 - x_2}$$

Angle of tilt $$\alpha_A = \operatorname{atan}\left(\frac{y_1 - y_2}{x_1 - x_2}\right)$$

for $x_1 = 0$

Bending line $$w_A(x) = \frac{y_2 - y_1}{x_2} \cdot x + \frac{x_2 \cdot y_1}{x_2}$$

Angle of tilt $$\alpha_A = \operatorname{atan}\left(\frac{y_2 - y_1}{x_2}\right)$$

$$w_A(x) = \frac{y_1 - y_2}{x_1 - x_2} \cdot x + \frac{x_1 \cdot y_2 - x_2 \cdot y_1}{x_1 - x_2}$$

for $x_1 = 0$ and $y_1 = 0$ $$w_A(x) = \frac{y_2}{x_2} \cdot x$$

$$\alpha_A = \operatorname{atan}\left(\frac{y_2}{x_2}\right)$$

$$w_A(x) = \frac{y_1 - y_2}{x_1 - x_2} \cdot x + \frac{x_1 \cdot y_2 - x_2 \cdot y_1}{x_1 - x_2}$$

for $y_2 = 0$ $$w_A(x) = \frac{y_1}{x_1 - x_2} \cdot x - \frac{x_2 \cdot y_1}{x_1 - x_2}$$

$$\alpha_A = \operatorname{atan}\left(\frac{-y_1}{x_2}\right)$$

B: Moment load at the left end of the beam (load case B)

Bending line $$w_B(x) = \frac{M \cdot l^2}{6 \cdot E \cdot I_y} \cdot \left[ 2 \cdot \frac{x}{l} - 3 \cdot \left(\frac{x}{l}\right)^2 + \left(\frac{x}{l}\right)^3 \right]$$

Angle of tilt (transfer region)

$$\alpha_{AB} = \frac{M \cdot l}{3 \cdot E \cdot I_y} \qquad \alpha_{BB} = \frac{-M \cdot l}{6 \cdot E \cdot I_y}$$

C: Moment load at the right end of the beam (load case C)

Bending line $$w_C(x) = \frac{-M \cdot l^2}{6 \cdot E \cdot I_y} \cdot \left[ \frac{x}{l} - \left( \frac{x}{l} \right)^3 \right]$$

Angle of tilt (transfer region)

$$\alpha_{AC} = \frac{-M \cdot l}{6 \cdot E \cdot I_y} \qquad \alpha_{BC} = \frac{M \cdot l}{3 \cdot E \cdot I_y}$$

D: Uniform transverse load over the entire beam (load case D)

Bending line

Angle of tilt (transfer region)

Fig. 8-4

$$w_D(x) = \frac{-q \cdot l^4}{24 \cdot E \cdot I_y} \cdot \left[ \frac{x}{l} - 2 \cdot \left( \frac{x}{l} \right)^3 + \left( \frac{x}{l} \right)^4 \right] \qquad \alpha_{AD} = \frac{-q \cdot l^3}{24 \cdot E \cdot I_y} \qquad \alpha_{BD} = \frac{q \cdot l^3}{24 \cdot E \cdot I_y}$$

Region 1

$l_0 = 0 \le x < L_1$

Superposition of A + C $$w_1(x) = \frac{-M_{L1} \cdot L_1^2}{6 \cdot E \cdot I_y} \cdot \left[ \frac{x}{L_1} - \left( \frac{x}{L_1} \right)^3 \right] + \frac{z_1}{L_1} \cdot x \qquad \alpha_{1_L1} = \frac{M_{L1} \cdot L_1}{3 \cdot E \cdot I_y} + \operatorname{atan}\left( \frac{z_1}{L_1} \right)$$

sought: $M_{L1}$;

Region 2

$L_1 \le x < L_2$

Superposition of A + B + C + D $l_2 = L_2 - L_1$ $$w_2(x) = \frac{z_1 - z_2}{x_1 - x_2} \cdot x + \frac{x_1 \cdot z_2 - x_2 \cdot z_1}{x_1 - x_2} + \frac{-M_{L1} \cdot l_2^2}{6 \cdot E \cdot I_y} \cdot \left[ 2 \cdot \frac{x}{l_2} - 3 \cdot \left( \frac{x}{l_2} \right)^2 + \left( \frac{x}{l_2} \right)^3 \right] + \frac{-M_{L2} \cdot l_2^2}{6 \cdot E \cdot I_y} \cdot \left[ \frac{x}{l_2} - \left( \frac{x}{l_2} \right)^3 \right] + \frac{-q \cdot l_2^4}{24 \cdot E \cdot I_y} \cdot \left[ \frac{x}{l_2} - 2 \cdot \left( \frac{x}{l_2} \right)^3 + \left( \frac{x}{l_2} \right)^4 \right]$$

sought: $M_{L1}$; $M_{L2}$;

$$\alpha_{2_L1} = \operatorname{atan}\left( \frac{z_1 - z_2}{-l_2} \right) + \frac{-M_{L1} \cdot l_2}{3 \cdot E \cdot I_y} + \frac{-M_{L2} \cdot l_2}{6 \cdot E \cdot I_y} + \frac{-q \cdot l_2^3}{24 \cdot E \cdot I_y}$$

$$\alpha_{2_L2} = \operatorname{atan}\left( \frac{z_1 - z_2}{-l_2} \right) + \frac{M_{L2} \cdot l_2}{3 \cdot E \cdot I_y} + \frac{M_{L1} \cdot l_2}{6 \cdot E \cdot I_y} + \frac{q \cdot l_2^3}{24 \cdot E \cdot I_y}$$

Region 3

$L_2 \le x < L_3$

Fig. 8-5

Superposition of A + B + C + D $l_3 = L_3 - L_2$ $$w_3(x) = \frac{z_2 - z_3}{x_1 - x_2} \cdot x + \frac{x_1 \cdot z_3 - x_2 \cdot z_2}{x_1 - x_2} + \frac{-M_{L2} \cdot l_3^2}{6 \cdot E \cdot I_y} \cdot \left[2 \cdot \frac{x}{l_3} - 3 \cdot \left(\frac{x}{l_3}\right)^2 + \left(\frac{x}{l_3}\right)^3\right] \ldots$$
$$+ \frac{-M_{L3} \cdot l_3^2}{6 \cdot E \cdot I_y} \cdot \left[\frac{x}{l_3} - \left(\frac{x}{l_3}\right)^3\right] + \frac{-q \cdot l_3^4}{24 \cdot E \cdot I_y} \cdot \left[\frac{x}{l_3} - 2 \cdot \left(\frac{x}{l_3}\right)^3 + \left(\frac{x}{l_3}\right)^4\right]$$

sought: $M_{L2}$; $M_{L3}$;

$$\alpha_{3_L2} = \operatorname{atan}\left(\frac{z_2 - z_3}{-l_3}\right) + \frac{-M_{L2} \cdot l_3}{3 \cdot E \cdot I_y} + \frac{-M_{L3} \cdot l_3}{6 \cdot E \cdot I_y} + \frac{-q \cdot l_3^3}{24 \cdot E \cdot I_y}$$

$$\alpha_{3_L3} = \operatorname{atan}\left(\frac{z_2 - z_3}{-l_3}\right) + \frac{M_{L3} \cdot l_3}{3 \cdot E \cdot I_y} + \frac{M_{L2} \cdot l_3}{6 \cdot E \cdot I_y} + \frac{q \cdot l_3^3}{24 \cdot E \cdot I_y}$$

Region 4

$L_3 \le x < L_4$

Superposition of A + B + C + D $l_4 = L_4 - L_3$ $$w_4(x) = \frac{z_3 - z_4}{-l_4} \cdot x + \frac{L_3 \cdot z_4 - L_4 \cdot z_3}{-l_4} + \frac{-M_{L3} \cdot l_4^2}{6 \cdot E \cdot I_y} \cdot \left[2 \cdot \frac{x - L_3}{l_4} - 3 \cdot \left(\frac{x - L_3}{l_4}\right)^2 + \left(\frac{x - L_3}{l_4}\right)^3\right] \ldots$$
$$+ \frac{-M_{L4} \cdot l_4^2}{6 \cdot E \cdot I_y} \cdot \left[\frac{x - L_3}{l_4} - \left(\frac{x - L_3}{l_4}\right)^3\right] + \frac{-q \cdot l_4^4}{24 \cdot E \cdot I_y} \cdot \left[\frac{x - L_3}{l_4} - 2 \cdot \left(\frac{x - L_3}{l_4}\right)^3 + \left(\frac{x - L_3}{l_4}\right)^4\right]$$

sought: $M_{L3}$; $M_{L4}$;

$$\alpha_{4_L3} = \operatorname{atan}\left(\frac{z_3 - z_4}{-l_4}\right) + \frac{-M_{L3} \cdot l_4}{3 \cdot E \cdot I_y} + \frac{-M_{L4} \cdot l_4}{6 \cdot E \cdot I_y} + \frac{-q \cdot l_4^3}{24 \cdot E \cdot I_y}$$

$$\alpha_{4_L4} = \operatorname{atan}\left(\frac{z_3 - z_4}{-l_4}\right) + \frac{M_{L4} \cdot l_4}{3 \cdot E \cdot I_y} + \frac{M_{L3} \cdot l_4}{6 \cdot E \cdot I_y} + \frac{q \cdot l_4^3}{24 \cdot E \cdot I_y}$$

Region 5

$L_4 \le x < L_5$

Fig. 8-6

Superposition of A + B + C + D $$w_5(x) = \frac{z_4 - z_5}{-l_5} \cdot x + \frac{L_4 \cdot z_5 - L_5 \cdot z_4}{-l_5} + \frac{-M_{L4} \cdot l_5^2}{6 \cdot E \cdot I_y} \cdot \left[ 2 \cdot \frac{x - L_4}{l_5} - 3 \cdot \left( \frac{x - L_4}{l_5} \right)^2 + \left( \frac{x - L_4}{l_5} \right)^3 \right] \ldots$$
$$+ \frac{-M_{L5} \cdot l_5^2}{6 \cdot E \cdot I_y} \cdot \left[ \frac{x - L_4}{l_5} - \left( \frac{x - L_4}{l_5} \right)^3 \right] + \frac{-q \cdot l_5^4}{24 \cdot E \cdot I_y} \cdot \left[ \frac{x - L_4}{l_5} - 2 \cdot \left( \frac{x - L_4}{l_5} \right)^3 + \left( \frac{x - L_4}{l_5} \right)^4 \right]$$

sought: $M_{L4}$; $M_{L5}$;

$$\alpha_{5_L4} = \operatorname{atan}\left( \frac{z_4 - z_5}{-l_5} \right) + \frac{-M_{L4} \cdot l_5}{3 \cdot E \cdot I_y} + \frac{-M_{L5} \cdot l_5}{6 \cdot E \cdot I_y} + \frac{-q \cdot l_5^3}{24 \cdot E \cdot I_y}$$

$$\alpha_{5_L5} = \operatorname{atan}\left( \frac{z_4 - z_5}{-l_5} \right) + \frac{M_{L5} \cdot l_5}{3 \cdot E \cdot I_y} + \frac{M_{L4} \cdot l_5}{6 \cdot E \cdot I_y} + \frac{q \cdot l_5^3}{24 \cdot E \cdot I_y}$$

<u>Region 6</u>

$L_5 \le x < L_6$

Superposition of A + B + C + D $l_6 = L_6 - L_5$ $$w_6(x) = \frac{z_5 - z_6}{-l_6} \cdot x + \frac{L_5 \cdot z_6 - L_6 \cdot z_5}{-l_6} + \frac{-M_{L5} \cdot l_6^2}{6 \cdot E \cdot I_y} \cdot \left[ 2 \cdot \frac{x - L_5}{l_6} - 3 \cdot \left( \frac{x - L_5}{l_6} \right)^2 + \left( \frac{x - L_5}{l_6} \right)^3 \right] \ldots$$
$$+ \frac{-M_{L6} \cdot l_6^2}{6 \cdot E \cdot I_y} \cdot \left[ \frac{x - L_5}{l_6} - \left( \frac{x - L_5}{l_6} \right)^3 \right] + \frac{-q \cdot l_6^4}{24 \cdot E \cdot I_y} \cdot \left[ \frac{x - L_5}{l_6} - 2 \cdot \left( \frac{x - L_5}{l_6} \right)^3 + \left( \frac{x - L_5}{l_6} \right)^4 \right]$$

sought: $M_{L4}$; $M_{L5}$;

$$\alpha_{6_L5} = \operatorname{atan}\left( \frac{z_5 - z_6}{-l_6} \right) + \frac{-M_{L5} \cdot l_6}{3 \cdot E \cdot I_y} + \frac{-M_{L6} \cdot l_6}{6 \cdot E \cdot I_y} + \frac{-q \cdot l_6^3}{24 \cdot E \cdot I_y}$$

$$\alpha_{6_L6} = \operatorname{atan}\left( \frac{z_5 - z_6}{-l_6} \right) + \frac{M_{L6} \cdot l_6}{3 \cdot E \cdot I_y} + \frac{M_{L5} \cdot l_6}{6 \cdot E \cdot I_y} + \frac{q \cdot l_6^3}{24 \cdot E \cdot I_y}$$

Fig. 8-7

Region 7

$L_6 \le x < L_7$

Superposition of A + B + C + D $l_7 = L_7 - L_6$ $$w_7(x) = \frac{z_6 - z_7}{-l_7} \cdot x + \frac{L_6 \cdot z_7 - L_7 \cdot z_6}{-l_7} + \frac{-M_{L6} \cdot l_7^2}{6 \cdot E \cdot I_y} \cdot \left[2 \cdot \frac{x - L_6}{l_7} - 3 \cdot \left(\frac{x - L_6}{l_7}\right)^2 + \left(\frac{x - L_6}{l_7}\right)^3\right] \ldots$$
$$+ \frac{-M_{L7} \cdot l_7^2}{6 \cdot E \cdot I_y} \cdot \left[\frac{x - L_6}{l_7} - \left(\frac{x - L_6}{l_7}\right)^3\right] + \frac{-q \cdot l_7^4}{24 \cdot E \cdot I_y} \cdot \left[\frac{x - L_6}{l_7} - 2 \cdot \left(\frac{x - L_6}{l_7}\right)^3 + \left(\frac{x - L_6}{l_7}\right)^4\right]$$

sought: $M_{L6}$; $M_{L7}$;

$$\alpha_{7_L6} = \operatorname{atan}\left(\frac{z_6 - z_7}{-l_7}\right) + \frac{-M_{L6} \cdot l_7}{3 \cdot E \cdot I_y} + \frac{-M_{L7} \cdot l_7}{6 \cdot E \cdot I_y} + \frac{-q \cdot l_7^3}{24 \cdot E \cdot I_y}$$

$$\alpha_{7_L7} = \operatorname{atan}\left(\frac{z_6 - z_7}{-l_7}\right) + \frac{M_{L7} \cdot l_7}{3 \cdot E \cdot I_y} + \frac{M_{L6} \cdot l_7}{6 \cdot E \cdot I_y} + \frac{q \cdot l_7^3}{24 \cdot E \cdot I_y}$$

Region 8

$L_7 \le x < L_8$

Superposition of A + B + C + D $l_8 = L_8 - L_7$ $$w_8(x) = \frac{z_7 - z_8}{-l_8} \cdot x + \frac{L_7 \cdot z_8 - L_8 \cdot z_7}{-l_8} + \frac{-M_{L7} \cdot l_8^2}{6 \cdot E \cdot I_y} \cdot \left[2 \cdot \frac{x - L_7}{l_8} - 3 \cdot \left(\frac{x - L_7}{l_8}\right)^2 + \left(\frac{x - L_7}{l_8}\right)^3\right] \ldots$$
$$+ \frac{-M_{L8} \cdot l_8^2}{6 \cdot E \cdot I_y} \cdot \left[\frac{x - L_7}{l_8} - \left(\frac{x - L_7}{l_8}\right)^3\right] + \frac{-q \cdot l_8^4}{24 \cdot E \cdot I_y} \cdot \left[\frac{x - L_7}{l_8} - 2 \cdot \left(\frac{x - L_7}{l_8}\right)^3 + \left(\frac{x - L_7}{l_8}\right)^4\right]$$

sought: $M_{L7}$; $M_{L8}$;

$$\alpha_{8_L7} = \operatorname{atan}\left(\frac{z_7 - z_8}{-l_8}\right) + \frac{-M_{L7} \cdot l_8}{3 \cdot E \cdot I_y} + \frac{-M_{L8} \cdot l_8}{6 \cdot E \cdot I_y} + \frac{-q \cdot l_8^3}{24 \cdot E \cdot I_y}$$

$$\alpha_{8_L8} = \operatorname{atan}\left(\frac{z_7 - z_8}{-l_8}\right) + \frac{M_{L8} \cdot l_8}{3 \cdot E \cdot I_y} + \frac{M_{L7} \cdot l_8}{6 \cdot E \cdot I_y} + \frac{q \cdot l_8^3}{24 \cdot E \cdot I_y}$$

Fig. 8-8

Region 9 - Superposition of A + B + C + D $L_8 \le x < L_9$ $l_9 = L_9 - L_8$ $$w_9(x) = \frac{z_8 - z_9}{-l_9} \cdot x + \frac{L_8 \cdot z_9 - L_9 \cdot z_8}{-l_9} + \frac{-M_{L8} \cdot l_9^2}{6 \cdot E \cdot I_y} \cdot \left[ 2 \cdot \frac{x - L_8}{l_9} - 3 \cdot \left( \frac{x - L_8}{l_9} \right)^2 + \left( \frac{x - L_8}{l_9} \right)^3 \right] \ldots$$
$$+ \frac{-M_{L9} \cdot l_9^2}{6 \cdot E \cdot I_y} \cdot \left[ \frac{x - L_8}{l_9} - \left( \frac{x - L_8}{l_9} \right)^3 \right] + \frac{-q \cdot l_9^4}{24 \cdot E \cdot I_y} \left[ \frac{x - L_8}{l_9} - 2 \cdot \left( \frac{x - L_8}{l_9} \right)^3 + \left( \frac{x - L_8}{l_9} \right)^4 \right]$$

sought: $M_{L8}$; $M_{L9}$;

$$\alpha_{9_L8} = \operatorname{atan}\left( \frac{z_8 - z_9}{-l_9} \right) + \frac{-M_{L8} \cdot l_9}{3 \cdot E \cdot I_y} + \frac{-M_{L9} \cdot l_9}{6 \cdot E \cdot I_y} + \frac{-q \cdot l_9^3}{24 \cdot E \cdot I_y}$$

$$\alpha_{9_L9} = \operatorname{atan}\left( \frac{z_8 - z_9}{-l_9} \right) + \frac{M_{L9} \cdot l_9}{3 \cdot E \cdot I_y} + \frac{M_{L8} \cdot l_9}{6 \cdot E \cdot I_y} + \frac{q \cdot l_9^3}{24 \cdot E \cdot I_y}$$

Region 10 - Superposition of A + B + C + D $L_9 \le x < L_{10}$ $l_{10} = L_{10} - L_9$ $$w_{10}(x) = \frac{z_9 - z_{10}}{-l_{10}} \cdot x + \frac{L_9 \cdot z_{10} - L_{10} \cdot z_9}{-l_{10}} + \frac{-M_{L9} \cdot l_{10}^2}{6 \cdot E \cdot I_y} \cdot \left[ 2 \cdot \frac{x - L_9}{l_{10}} - 3 \cdot \left( \frac{x - L_9}{l_{10}} \right)^2 + \left( \frac{x - L_9}{l_{10}} \right)^3 \right] \ldots$$
$$+ \frac{-M_{L10} \cdot l_{10}^2}{6 \cdot E \cdot I_y} \cdot \left[ \frac{x - L_9}{l_{10}} - \left( \frac{x - L_9}{l_{10}} \right)^3 \right] + \frac{-q \cdot l_{10}^4}{24 \cdot E \cdot I_y} \left[ \frac{x - L_9}{l_{10}} - 2 \cdot \left( \frac{x - L_9}{l_{10}} \right)^3 + \left( \frac{x - L_9}{l_{10}} \right)^4 \right]$$

sought: $M_{L9}$; $M_{L10}$;

$$\alpha_{10_L9} = \operatorname{atan}\left( \frac{z_9 - z_{10}}{-l_{10}} \right) + \frac{-M_{L9} \cdot l_{10}}{3 \cdot E \cdot I_y} + \frac{-M_{L10} \cdot l_{10}}{6 \cdot E \cdot I_y} + \frac{-q \cdot l_{10}^3}{24 \cdot E \cdot I_y}$$

$$\alpha_{10_L10} = \operatorname{atan}\left( \frac{z_9 - z_{10}}{-l_{10}} \right) + \frac{M_{L10} \cdot l_{10}}{3 \cdot E \cdot I_y} + \frac{M_{L9} \cdot l_{10}}{6 \cdot E \cdot I_y} + \frac{q \cdot l_{10}^3}{24 \cdot E \cdot I_y}$$

Fig. 8-9

Region 11

$L_{10} \le x < L_{11}$

Superposition of A + B + C + D $l_{11} = L_{11} - L_{10}$ $$w_{11}(x) = \frac{z_{10} - z_{11}}{-l_{11}} \cdot x + \frac{L_{10} \cdot z_{11} - L_{11} \cdot z_{10}}{-l_{11}} + \frac{-M_{L10} \cdot l_{11}^2}{6 \cdot E \cdot I_y} \cdot \left[ 2 \cdot \frac{x - L_{10}}{l_{11}} - 3 \cdot \left( \frac{x - L_{10}}{l_{11}} \right)^2 + \left( \frac{x - L_{10}}{l_{11}} \right)^3 \right] \ldots$$
$$+ \frac{-M_{L11} \cdot l_{11}^2}{6 \cdot E \cdot I_y} \cdot \left[ \frac{x - L_{10}}{l_{11}} - \left( \frac{x - L_{10}}{l_{11}} \right)^3 \right] + \frac{-q \cdot l_{11}^4}{24 \cdot E \cdot I_y} \cdot \left[ \frac{x - L_{10}}{l_{11}} - 2 \cdot \left( \frac{x - L_{10}}{l_{11}} \right)^3 + \left( \frac{x - L_{10}}{l_{11}} \right)^4 \right]$$

sought: $M_{L3}$; $M_{L4}$;

$$\alpha_{11_L10} = \operatorname{atan}\left( \frac{z_{10} - z_{11}}{-l_{11}} \right) + \frac{-M_{L10} \cdot l_{11}}{3 \cdot E \cdot I_y} + \frac{-M_{L11} \cdot l_{11}}{6 \cdot E \cdot I_y} + \frac{-q \cdot l_{11}^3}{24 \cdot E \cdot I_y}$$

$$\alpha_{11_L11} = \operatorname{atan}\left( \frac{z_{10} - z_{11}}{-l_{11}} \right) + \frac{M_{L11} \cdot l_{11}}{3 \cdot E \cdot I_y} + \frac{M_{L10} \cdot l_{11}}{6 \cdot E \cdot I_y} + \frac{q \cdot l_{11}^3}{24 \cdot E \cdot I_y}$$

Region 12

$L_{11} \le x \le L_{12}$

Superposition of A + B $l_{12} = L_{12} - L_{11}$ $$w_{12}(x) = \frac{z_{11} - z_{12}}{-l_{12}} \cdot x + \frac{L_{11} \cdot z_{12} - L_{12} \cdot z_{11}}{-l_{12}} + \frac{-M_{L11} \cdot l_{12}^2}{6 \cdot E \cdot I_y} \cdot \left[ 2 \cdot \frac{x - L_{11}}{l_{12}} - 3 \cdot \left( \frac{x - L_{11}}{l_{12}} \right)^2 + \left( \frac{x - L_{11}}{l_{12}} \right)^3 \right]$$

with $z_{12} = 0$ $$\alpha_{12_L11} = \operatorname{atan}\left( \frac{z_{11} - z_{12}}{-l_{12}} \right) + \frac{-M_{L11} \cdot l_{12}}{3 \cdot E \cdot I_y}$$

Continuity conditions:

Equilibrium of moments at the transition points between the regions

Transition region 1 and 2:

$\alpha_{1_L1} = \alpha_{2_L1}$

Fig. 8-10

$$\frac{M_{L1}\cdot L_1}{3\cdot E\cdot I_y} + \operatorname{atan}\left(\frac{z_1}{L_1}\right) = \operatorname{atan}\left(\frac{z_1 - z_2}{-l_2}\right) + \frac{-M_{L1}\cdot l_2}{3\cdot E\cdot I_y} + \frac{-M_{L2}\cdot l_2}{6\cdot E\cdot I_y} + \frac{-q\cdot l_2^{\,3}}{24\cdot E\cdot I_y} \quad (1)$$

Transition region 2 and 3:

$\alpha_{2_L2} = \alpha_{3_L2}$ $$\operatorname{atan}\left(\frac{z_1 - z_2}{-l_2}\right) + \frac{M_{L2}\cdot l_2}{3\cdot E\cdot I_y} + \frac{M_{L1}\cdot l_2}{6\cdot E\cdot I_y} + \frac{q\cdot l_2^{\,3}}{24\cdot E\cdot I_y} = \operatorname{atan}\left(\frac{z_2 - z_3}{-l_3}\right) + \frac{-M_{L2}\cdot l_3}{3\cdot E\cdot I_y} + \frac{-M_{L3}\cdot l_3}{6\cdot E\cdot I_y} + \frac{-q\cdot l_3^{\,3}}{24\cdot E\cdot I_y} \quad (2)$$

Transition region 3 and 4:

$\alpha_{3_L3} = \alpha_{4_L3}$ $$\operatorname{atan}\left(\frac{z_2 - z_3}{-l_3}\right) + \frac{M_{L3}\cdot l_3}{3\cdot E\cdot I_y} + \frac{M_{L2}\cdot l_3}{6\cdot E\cdot I_y} + \frac{q\cdot l_3^{\,3}}{24\cdot E\cdot I_y} = \operatorname{atan}\left(\frac{z_3 - z_4}{-l_4}\right) + \frac{-M_{L3}\cdot l_4}{3\cdot E\cdot I_y} + \frac{-M_{L4}\cdot l_4}{6\cdot E\cdot I_y} + \frac{-q\cdot l_4^{\,3}}{24\cdot E\cdot I_y} \quad (3)$$

Transition region 4 and 5:

$\alpha_{4_L4} = \alpha_{5_L4}$ $$\operatorname{atan}\left(\frac{z_3 - z_4}{-l_4}\right) + \frac{M_{L4}\cdot l_4}{3\cdot E\cdot I_y} + \frac{M_{L3}\cdot l_4}{6\cdot E\cdot I_y} + \frac{q\cdot l_4^{\,3}}{24\cdot E\cdot I_y} = \operatorname{atan}\left(\frac{z_4 - z_5}{-l_5}\right) + \frac{-M_{L4}\cdot l_5}{3\cdot E\cdot I_y} + \frac{-M_{L5}\cdot l_5}{6\cdot E\cdot I_y} + \frac{-q\cdot l_5^{\,3}}{24\cdot E\cdot I_y} \quad (4)$$

Transition region 5 and 6:

$\alpha_{5_L5} = \alpha_{6_L5}$ $$\operatorname{atan}\left(\frac{z_4 - z_5}{-l_5}\right) + \frac{M_{L5}\cdot l_5}{3\cdot E\cdot I_y} + \frac{M_{L4}\cdot l_5}{6\cdot E\cdot I_y} + \frac{q\cdot l_5^{\,3}}{24\cdot E\cdot I_y} = \operatorname{atan}\left(\frac{z_5 - z_6}{-l_6}\right) + \frac{-M_{L5}\cdot l_6}{3\cdot E\cdot I_y} + \frac{-M_{L6}\cdot l_6}{6\cdot E\cdot I_y} + \frac{-q\cdot l_6^{\,3}}{24\cdot E\cdot I_y} \quad (5)$$

Transition region 6 and 7:

$\alpha_{6_L6} = \alpha_{7_L6}$

Fig. 8-11

$$\operatorname{atan}\left(\frac{z_5 - z_6}{-l_6}\right) + \frac{M_{L6} \cdot l_6}{3 \cdot E \cdot I_y} + \frac{M_{L5} \cdot l_6}{6 \cdot E \cdot I_y} + \frac{q \cdot l_6^3}{24 \cdot E \cdot I_y} = \operatorname{atan}\left(\frac{z_6 - z_7}{-l_7}\right) + \frac{-M_{L6} \cdot l_7}{3 \cdot E \cdot I_y} + \frac{-M_{L7} \cdot l_7}{6 \cdot E \cdot I_y} + \frac{-q \cdot l_7^3}{24 \cdot E \cdot I_y} \quad (6)$$

Transition region 7 and 8:

$$\alpha_{7_L7} = \alpha_{8_L7}$$

$$\operatorname{atan}\left(\frac{z_6 - z_7}{-l_7}\right) + \frac{M_{L7} \cdot l_7}{3 \cdot E \cdot I_y} + \frac{M_{L6} \cdot l_7}{6 \cdot E \cdot I_y} + \frac{q \cdot l_7^3}{24 \cdot E \cdot I_y} = \operatorname{atan}\left(\frac{z_7 - z_8}{-l_8}\right) + \frac{-M_{L7} \cdot l_8}{3 \cdot E \cdot I_y} + \frac{-M_{L8} \cdot l_8}{6 \cdot E \cdot I_y} + \frac{-q \cdot l_8^3}{24 \cdot E \cdot I_y} \quad (7)$$

Transition region 8 and 9:

$$\alpha_{8_L8} = \alpha_{9_L8}$$

$$\operatorname{atan}\left(\frac{z_7 - z_8}{-l_8}\right) + \frac{M_{L8} \cdot l_8}{3 \cdot E \cdot I_y} + \frac{M_{L7} \cdot l_8}{6 \cdot E \cdot I_y} + \frac{q \cdot l_8^3}{24 \cdot E \cdot I_y} = \operatorname{atan}\left(\frac{z_8 - z_9}{-l_9}\right) + \frac{-M_{L8} \cdot l_9}{3 \cdot E \cdot I_y} + \frac{-M_{L9} \cdot l_9}{6 \cdot E \cdot I_y} + \frac{-q \cdot l_9^3}{24 \cdot E \cdot I_y} \quad (8)$$

Transition region 9 and 10:

$$\alpha_{9_L9} = \alpha_{10_L9}$$

$$\operatorname{atan}\left(\frac{z_8 - z_9}{-l_9}\right) + \frac{M_{L9} \cdot l_9}{3 \cdot E \cdot I_y} + \frac{M_{L8} \cdot l_9}{6 \cdot E \cdot I_y} + \frac{q \cdot l_9^3}{24 \cdot E \cdot I_y} = \operatorname{atan}\left(\frac{z_9 - z_{10}}{-l_{10}}\right) + \frac{-M_{L9} \cdot l_{10}}{3 \cdot E \cdot I_y} + \frac{-M_{L10} \cdot l_{10}}{6 \cdot E \cdot I_y} + \frac{-q \cdot l_{10}^3}{24 \cdot E \cdot I_y} \quad (9)$$

Transition region 10 and 11:

$$\alpha_{10_L10} = \alpha_{11_L10}$$

$$\operatorname{atan}\left(\frac{z_9 - z_{10}}{-l_{10}}\right) + \frac{M_{L10} \cdot l_{10}}{3 \cdot E \cdot I_y} + \frac{M_{L9} \cdot l_{10}}{6 \cdot E \cdot I_y} + \frac{q \cdot l_{10}^3}{24 \cdot E \cdot I_y} = \operatorname{atan}\left(\frac{z_{10} - z_{11}}{-l_{11}}\right) \ldots + \frac{-M_{L10} \cdot l_{11}}{3 \cdot E \cdot I_y} + \frac{-M_{L11} \cdot l_{11}}{6 \cdot E \cdot I_y} + \frac{-q \cdot l_{11}^3}{24 \cdot E \cdot I_y} \quad (10)$$

Transition region 11 and 12:

$$\alpha_{11_L11} = \alpha_{12_L11}$$

Fig. 8-12

$$\operatorname{atan}\left(\frac{z_{10}-z_{11}}{-l_{11}}\right)+\frac{M_{L11}\cdot l_{11}}{3\cdot E\cdot I_y}+\frac{M_{L10}\cdot l_{11}}{6\cdot E\cdot I_y}+\frac{q\cdot l_{11}^{3}}{24\cdot E\cdot I_y}=\operatorname{atan}\left(\frac{z_{11}-z_{12}}{-l_{12}}\right)+\frac{-M_{L11}\cdot l_{12}}{3\cdot E\cdot I_y} \quad (11)$$

Equation system 1 to 11

$$M_{L1}=\left[3\cdot E\cdot I_y\cdot\left(\operatorname{atan}\left(\frac{z_1-z_2}{-l_2}\right)-\operatorname{atan}\left(\frac{z_1}{l_{12}}\right)\right)-\frac{M_{L2}\cdot l_2}{2}+\frac{-q\cdot l_2^{3}}{8}\right]\cdot\frac{1}{(l_{12}+l_2)} \quad (1)$$

$$M_{L2}=\frac{3\cdot E\cdot I_y}{2\cdot l_2}\cdot\left(\operatorname{atan}\left(\frac{z_2-z_3}{-l_2}\right)-\operatorname{atan}\left(\frac{z_1-z_2}{-l_2}\right)\right)+\frac{-M_{L3}}{4}+\frac{-q\cdot l_2^{2}}{8}-\frac{M_{L1}}{4} \quad (2)$$

$$M_{L3}=\frac{3\cdot E\cdot I_y}{2\cdot l_2}\cdot\left(\operatorname{atan}\left(\frac{z_3-z_4}{-l_2}\right)-\operatorname{atan}\left(\frac{z_2-z_3}{-l_2}\right)\right)+\frac{-M_{L4}}{4}+\frac{-q\cdot l_2^{2}}{8}-\frac{M_{L2}}{4} \quad (3)$$

$$M_{L4}=\frac{3\cdot E\cdot I_y}{2\cdot l_2}\cdot\left(\operatorname{atan}\left(\frac{z_4-z_5}{-l_2}\right)-\operatorname{atan}\left(\frac{z_3-z_4}{-l_2}\right)\right)+\frac{-M_{L5}}{4}+\frac{-q\cdot l_2^{2}}{8}-\frac{M_{L3}}{4} \quad (4)$$

$$M_{L5}=\frac{3\cdot E\cdot I_y}{2\cdot l_2}\cdot\left(\operatorname{atan}\left(\frac{z_5-z_6}{-l_2}\right)-\operatorname{atan}\left(\frac{z_4-z_5}{-l_2}\right)\right)+\frac{-M_{L6}}{4}+\frac{-q\cdot l_2^{2}}{8}-\frac{M_{L4}}{4} \quad (5)$$

$$M_{L6}=\frac{3\cdot E\cdot I_y}{2\cdot l_2}\cdot\left(\operatorname{atan}\left(\frac{z_6-z_7}{-l_2}\right)-\operatorname{atan}\left(\frac{z_5-z_6}{-l_2}\right)\right)+\frac{-M_{L7}}{4}+\frac{-q\cdot l_2^{2}}{8}-\frac{M_{L5}}{4} \quad (6)$$

$$M_{L7}=\frac{3\cdot E\cdot I_y}{2\cdot l_2}\cdot\left(\operatorname{atan}\left(\frac{z_7-z_8}{-l_2}\right)-\operatorname{atan}\left(\frac{z_6-z_7}{-l_2}\right)\right)+\frac{-M_{L8}}{4}+\frac{-q\cdot l_2^{2}}{8}-\frac{M_{L6}}{4} \quad (7)$$

$$M_{L8}=\frac{3\cdot E\cdot I_y}{2\cdot l_2}\cdot\left(\operatorname{atan}\left(\frac{z_8-z_9}{-l_2}\right)-\operatorname{atan}\left(\frac{z_7-z_8}{-l_2}\right)\right)+\frac{-M_{L9}}{4}+\frac{-q\cdot l_2^{2}}{8}-\frac{M_{L7}}{4} \quad (8)$$

$$M_{L9}=\frac{3\cdot E\cdot I_y}{2\cdot l_2}\cdot\left(\operatorname{atan}\left(\frac{z_9-z_{10}}{-l_2}\right)-\operatorname{atan}\left(\frac{z_8-z_9}{-l_2}\right)\right)+\frac{-M_{L10}}{4}+\frac{-q\cdot l_2^{2}}{8}-\frac{M_{L8}}{4} \quad (9)$$

$$M_{L10}=\frac{3\cdot E\cdot I_y}{2\cdot l_2}\cdot\left(\operatorname{atan}\left(\frac{z_{10}-z_{11}}{-l_2}\right)-\operatorname{atan}\left(\frac{z_9-z_{10}}{-l_2}\right)\right)+\frac{-M_{L11}}{4}+\frac{-q\cdot l_2^{2}}{8}-\frac{M_{L9}}{4} \quad (10)$$

$$M_{L11}=\left[3\cdot E\cdot I_y\cdot\left(\operatorname{atan}\left(\frac{z_{11}-z_{12}}{-l_{12}}\right)-\operatorname{atan}\left(\frac{z_{10}-z_{11}}{-l_2}\right)\right)-\frac{q\cdot l_2^{3}}{8}-\frac{M_{L10}\cdot l_2}{2}\right]\cdot\frac{1}{l_{12}+l_2} \quad (11)$$

Stresses in the straightening roller $\sigma_{Li} = \frac{M_{Li}}{W_b}$ $i = 1..12$

Fig. 8-13

Moment load

Polar moment of inertia $T_A$ $$T_w(x) = \begin{cases} 0 \text{ if } 0 \le x < L_1 \\ \frac{T_A \cdot (L_1 - x)}{L_1 - L_{11}} \text{ if } L_1 \le x < L_{11} \\ T_A \text{ if } (L_{11} \le x \le L_{12}) \end{cases}$$

$W_t = \frac{\pi}{16} \cdot d^3$ max. torsional sress $\tau_{max} = \frac{T_A}{W_t}$ <u>Strength detection under dynamic load</u> defined resistance to fatigue fracture: $S_D := 4$ $\tau(x) = \frac{T_w(x)}{W_t}$ Comparison stress curve according to GEH:

$\sigma_v(x) = \sqrt{\sigma(x)^2 + 3 \cdot (0.7 \cdot \tau(x))^2}$

Simplification: in order to be independent of the strip running direction, the max. torsional stress is added to the max. bending stress according to GEH $\sigma_{v_max} = \sqrt{\max(M, B)^2 + 3 \cdot (0.7\tau_{max})^2}$

METHOD AND COMPUTER PROGRAM PRODUCT FOR SETTING THE BENDING OF AT LEAST ONE STRAIGHTENING ROLLER OF A ROLLER STRAIGHTENING MACHINE

RELATED APPLICATIONS

The present application is National Phase of International Application No. PCT/EP2018/078222 filed Oct. 16, 2018, and claims priority from German Application No. 10 2017 124 027.6, filed Oct. 16, 2017, the disclosure of which is hereby incorporated by reference herein in its entirety.

The invention relates to a method, an apparatus and a computer program product for setting the bending of at least one straightening roller of a roller straightening machine.

EP 0 035 009 B1 discloses an apparatus for supporting a working roller of a sheet metal bending or straightening machine. In this case, a working or straightening roller is supported by means of a plurality of supporting roller devices arranged beside one another in the axial direction. Each supporting roller device is adjustable relative to the straightening roller by means of an actuating device, such that a force is exertable onto the straightening roller by an adjustment of the actuating device via the supporting rollers. A bending of the straightening roller is set automatically by means of the actuating devices, such that the bending corresponds to a predefined target value. A bending of the straightening roller is thus always kept constant, regardless of the loading forces that are occurring.

EP 1 673 181 B1 discloses a method for increasing the control accuracy of the path of a product in a straightening machine. In this case, a distance value of the straightening rollers is measured at the input of the straightening machine and at the output of the straightening machine and is compared with a reference value, which is stored in a model. The distance value is held automatically in the region of the stored reference value.

EP 0 570 770 B1 described a method for straightening sheets and strips. In this case, actuating devices are hydraulically adjustable by means of adjusting cylinders. The forces acting on the adjusting cylinders are measured during the straightening of a sheet. depending on the measured values, the adjusting cylinders can be controlled such that the straightening gap is kept parallel.

The objective of the methods according to the prior art is to always keep a predefined width of a straightening gap constant, regardless of the load acting on the straightening rollers. Nevertheless, in practice sometimes not all planarity errors are remedied when straightening sheet metal strips. A distinction is made here between. "geometrically developable planarity errors" and "geometrically non-developable planarity errors". A geometrically developable planarity error is, for example, what is known as a "coil curvature", in which case the sheet metal strip has a curvature as a result of a uniaxial stress state. The geometrically non-developable planarity errors include, for example, only middle waves or only edge waves occurring at the sheet metal edge. Planarity errors of this kind are caused by multi-axial stress states. In order to reduce planarity errors of this kind, it is sometimes necessary to manually adjust the straightening gap formed between the straightening rollers. Such an adjustment of the straightening gap requires experience and is time-consuming.

EP 0 182 062 A2 discloses a supporting roller adjustment for straightening machines. In order to improve the straightening result, it is checked after the adjustment of a supporting roller whether adjacent supporting rollers then still rest against the straightening roller. If this is not the case, the adjacent supporting rollers are adjusted such that they rest against the straightening roller. With the known method, an improved straightening result may indeed be achieved. However, with application of the known method, the straightening rollers may be damaged.

The object of the invention is to describe a method, an apparatus and a computer program product with which the time required to manually adjust the straightening gap in a roller straightening machine is reduced. In addition, inadmissibly high stress states in the straightening rollers should be safely and reliably avoided.

This problem is solved by the features of the invention.

In accordance with the invention, a method for adjusting the bending of at least one straightening roller of a roller straightening machine is proposed, wherein the straightening roller is supported by means of a plurality of supporting roller devices arranged beside one another in the axial direction, wherein each supporting roller device can be adjusted by means of an actuating device such that stresses are produced in the straightening roller, wherein, to control the actuating device, a control system is provided, by means of which the adjustment of the supporting roller device can be set manually, wherein limiting values with respect to the stresses produced in the straightening roller are stored in the control system, and wherein, in the event of a change in the adjustment of one of the supporting roller devices, maxima and minima of the stresses produced in the straightening roller are calculated and it is checked whether the maxima and minima lie within the limiting values and, if this is not the case, a further adjustment of at least one of the further supporting roller devices is changed automatically by means of the control system and in accordance with a predefined algorithm, such that the stresses produced in the straightening roller remain within the limiting values.

An adjustment of the supporting roller device directed towards the straightening roller results in an increase of compressive and/or tensile stresses in the straightening roller, and vice versa. A "width" of the straightening roller extends over its axial direction. A "bending" of the straightening roller can be adjusted individually by the supporting roller devices arranged beside one another in the axial direction of the straightening roller.

By means of the supporting roller devices, the straightening roller can be bent in an arched or also wavy fashion. In this case, compressive and/or tensile stresses are produced in the straightening roller by the supporting roller devices and/or the sheet metal guided through between the straightening rollers. The predefined limiting values describe maximum values for the compressive and tensile stresses, which result, inter alia, from material characteristics of the material used to produce the straightening roller.

In order to support the straightening roller, a plurality of supporting roller devices, for example three to twelve, may be arranged beside one another, depending on the width of the straightening roller. The roller straightening machine usually comprises a plurality of straightening rollers arranged successively in the transport direction. In this case, the supporting roller devices arranged beside one another extend along the transport direction over all straightening rollers.

Markers are advantageously applied at the outlet of the roller straightening machine and specify the position and description of the supporting roller devices. If a planarity error is observed in the sheet metal strip at the outlet of the roller straightening machine, an operator will first manually change the adjustment of a supporting roller device by means of the control system. If the adjustment of a supporting roller device changes, the resulting maxima and minima of the stress produced in the straightening roller are then calculated. It is checked whether the maxima and minima are within the predefined limiting values. If this is not the case, a further adjustment of at least one of the further supporting roller devices is automatically changed by means of the control system in accordance with a predefined algorithm, such that the stresses produced in the straightening roller remain within the limiting values. By way of the method according to the invention, it is thus no longer necessary for the operator to manually adjust a number of actuating devices in order to remedy a planarity error. The time to remedy a planarity error thus may be reduced significantly. Apart from this, inadmissibly high stresses within the straightening rollers are safely and reliably avoided. Such inadmissibly high stresses may lead to superficial cracks in the straightening rollers. The method according to the invention equally allows new freedoms in respect of the adjustment of the bending lines of straightening rollers. Further adjustment possibilities are thus created, whereby planarity errors in the sheet metal strip may be remedied even more effectively.

A roller straightening machine comprises an upper and a lower roller mill. The upper roller mill comprises upper straightening rollers. The lower roller mill comprises lower straightening rollers. The upper and the lower straightening rollers are arranged offset from one another in the transport direction, so that a sheet metal strip guided through a straightening gap formed between the upper and the lower straightening rollers is moved along a wavy line.

In the description of the present invention it is assumed that the upper straightening rollers assume a constant position, i.e. are unable to be deformed or cambered by means of actuating devices. The lower roller mill, by contrast, comprises lower straightening rollers which may be cambered. In the sense of the present invention, the term "straightening roller" shall be understood to mean a cambered straightening roller. Within the scope of the present invention, it is of course also possible that the upper roller mill comprises straightening rollers that are able to be cambered, and the lower straightening rollers of the lower roller mill are unable to be cambered.

Starting from the position of the supporting roller device, the adjustment of an adjacent further supporting roller device is advantageously changed by means of the algorithm. If the limiting values are unable to be complied with as a result of this change, the adjustment of further adjacent supporting roller devices is advantageously changed iteratively by means of the algorithm until the stresses produced in the straightening roller lie within the limiting values. If this is not the case, further adjacent supporting roller devices are adjusted iteratively. This step-by-step process is performed until the stresses produced in the straightening roller lie within the limiting values.

In accordance with a further advantageous embodiment, torsional stresses brought about by a drive of the straightening roller are superposed in order to calculate the stresses. Such torsional stresses usually increase the stresses produced in the straightening roller. The consideration of the torsional stresses leads to more exact results. The service life of the straightening roller may thus be further increased.

In accordance with a further embodiment of the method, the algorithm comprises a "tilt" adjustment mode, in which an adjustment of the actuating device is changeable such that the straightening roller is "tilted" in some sections about an axis running parallel to a transport direction. In the "tilt" adjustment mode, the further actuating devices are automatically adjusted by means of the algorithm in the event of manual actuation of an actuating device, such that the straightening roller is "tilted" in some sections relative to an opposite, upper straightening roller. In other words, in the "tilt" adjustment mode, the value of the straightening gap over the width of the straightening roller may be changed in some sections. For example, an edge waviness in the sheet metal strip may thus be remedied.

The actuating device advantageously comprises two wedges displaceable relative to one another, on which a holding device receiving the supporting rollers is supported. A change to the adjustment may be brought about by a displacement of at least one of the wedges relative to the holding device. The wedges may be adjusted relative to one another for example by means of an electromotively driven spindle drive. The actuating device, however, may also be designed differently. For example, it may also be a hydraulic device having one or more working cylinders.

In accordance with a further embodiment, it may also be that the straightening roller is supported on the supporting roller devices with two intermediate rollers arranged in between. A formation of groove-like indentations in the straightening rollers caused by the supporting rollers, and a resultant deformation on the outer side of the sheet metal may thus be avoided.

In accordance with a further aspect of the invention, an apparatus for adjusting the bending of at least one straightening roller of a roller straightening machine is proposed. With regard to the apparatus and the embodiments described in the features, reference is made to the previous embodiments of the method, which are also applicable correspondingly to the apparatus.

In accordance with a further aspect of the invention, a computer program product for adjusting the bending of at least one straightening roller of a roller straightening machine is lastly proposed, comprising computer instructions on a computer-readable storage medium which prompt the control system to carry out the method according to the invention when the instructions are read by the control system and executed.

The control system expediently comprises a process calculator or computer by means of which the method according to the invention may be carried out.

Exemplary embodiments of the invention will be explained in greater detail hereinafter with reference to the drawings, in which.

Figure 1:
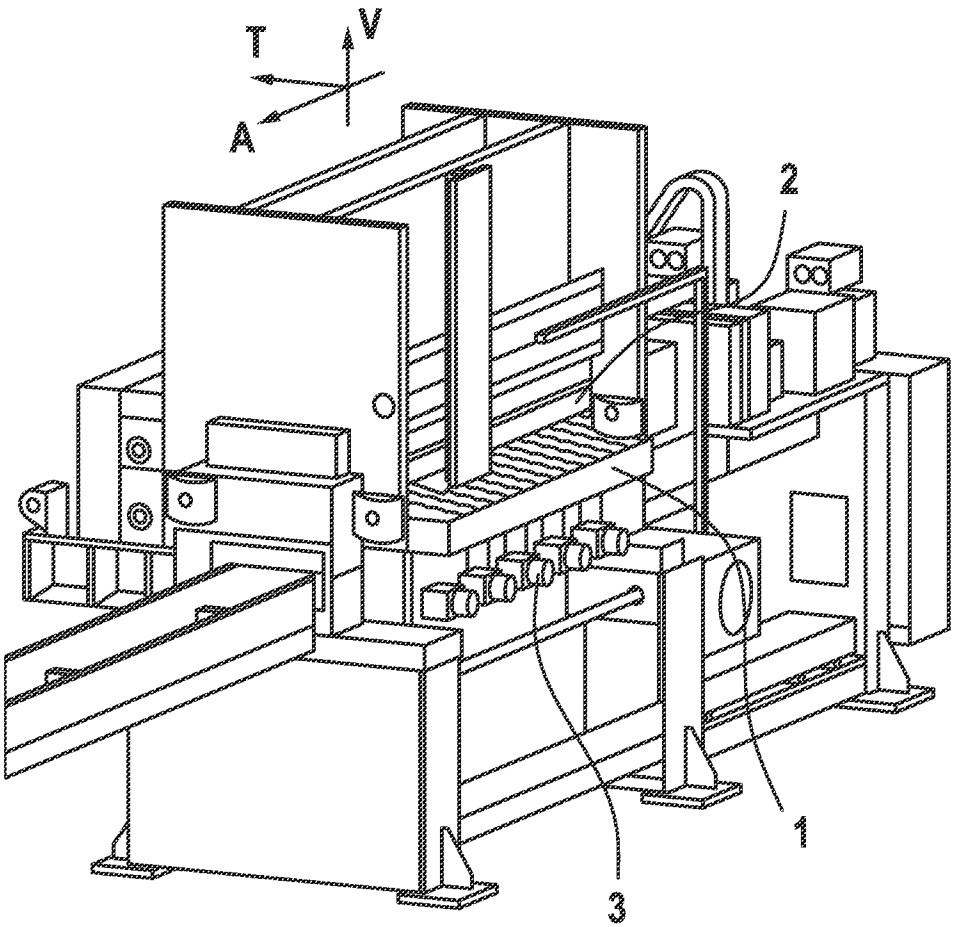
FIG. 1 shows a perspective view of a roller straightening machine.
Figure 3:
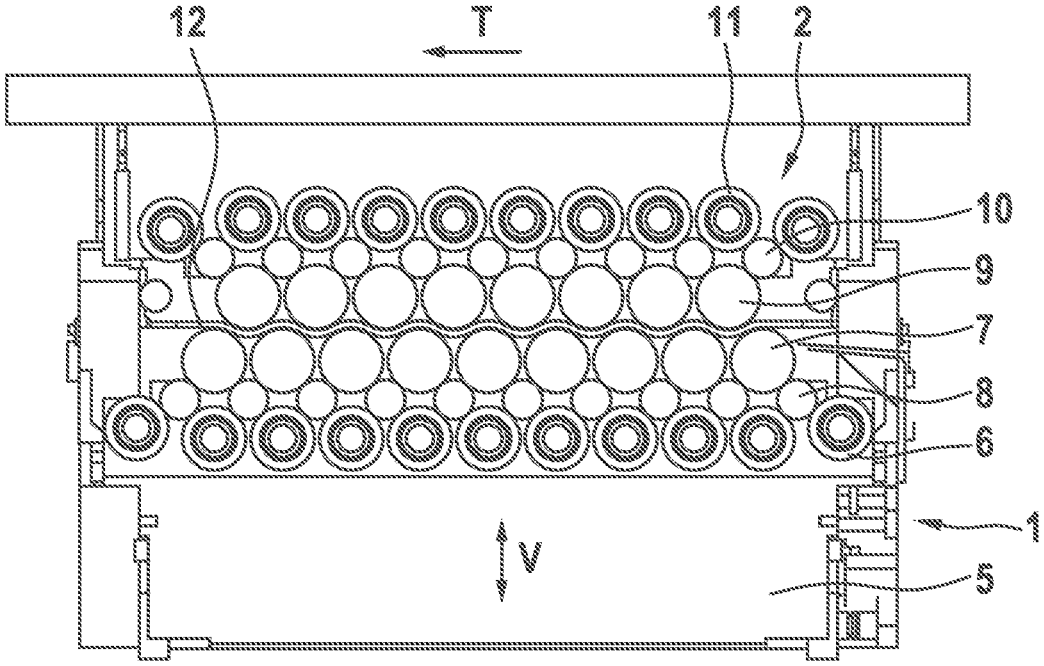
Figure 4:
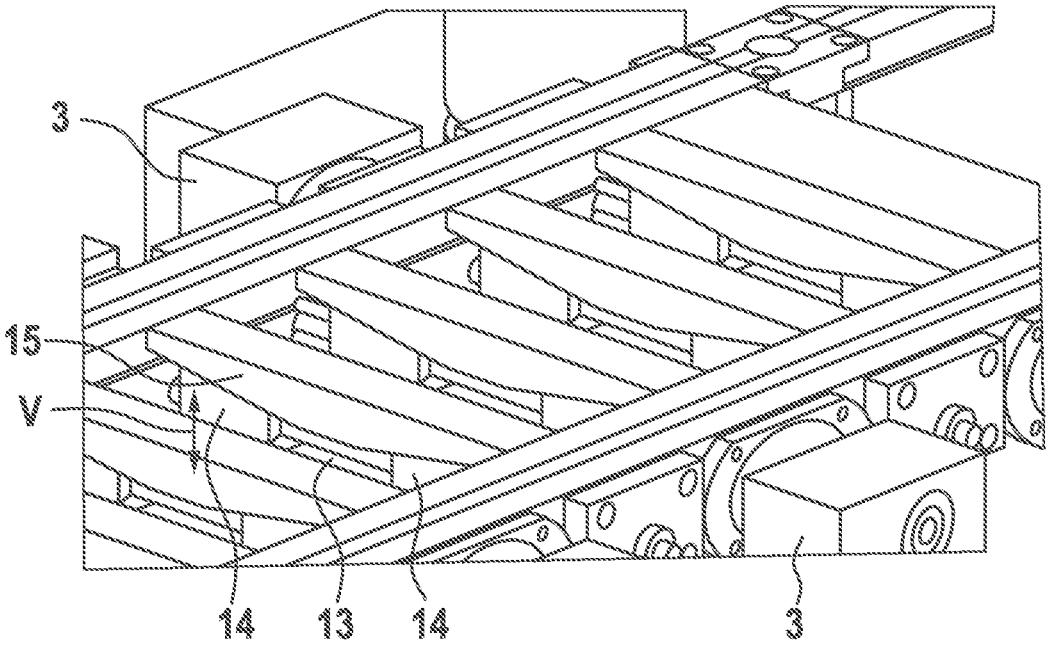
Figure 5:
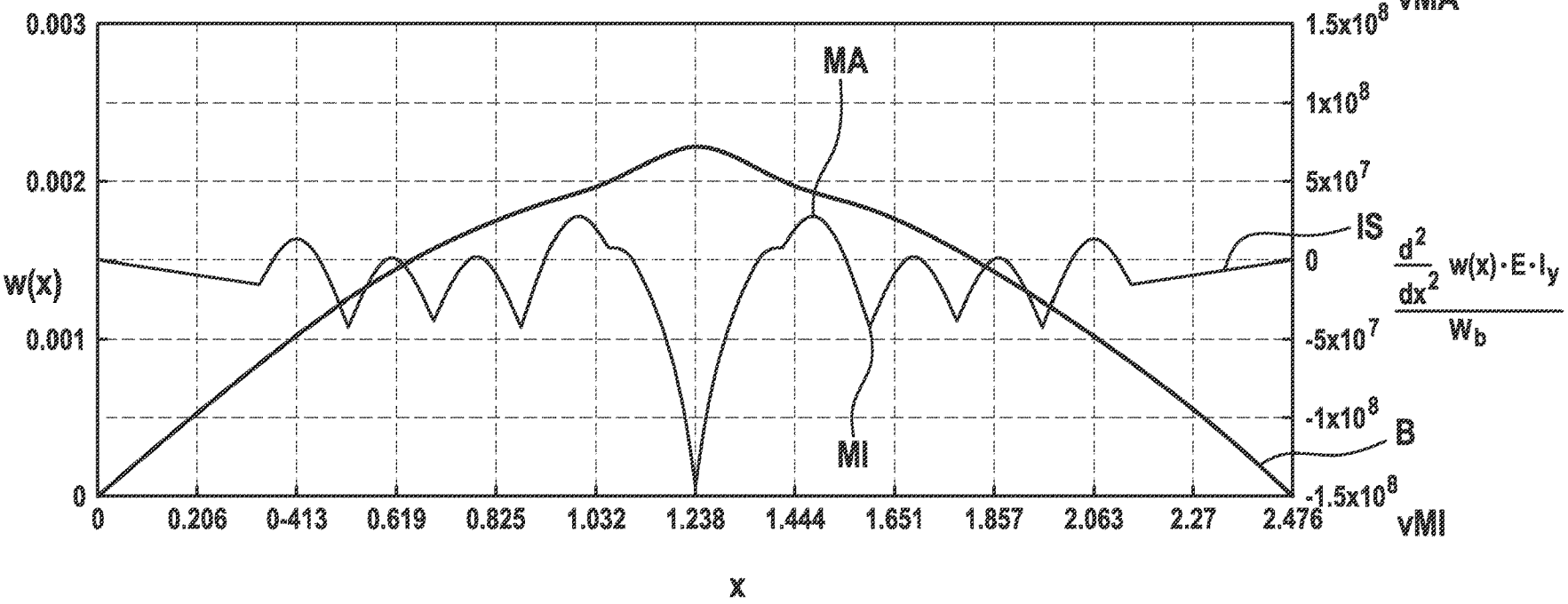
Figure 6:
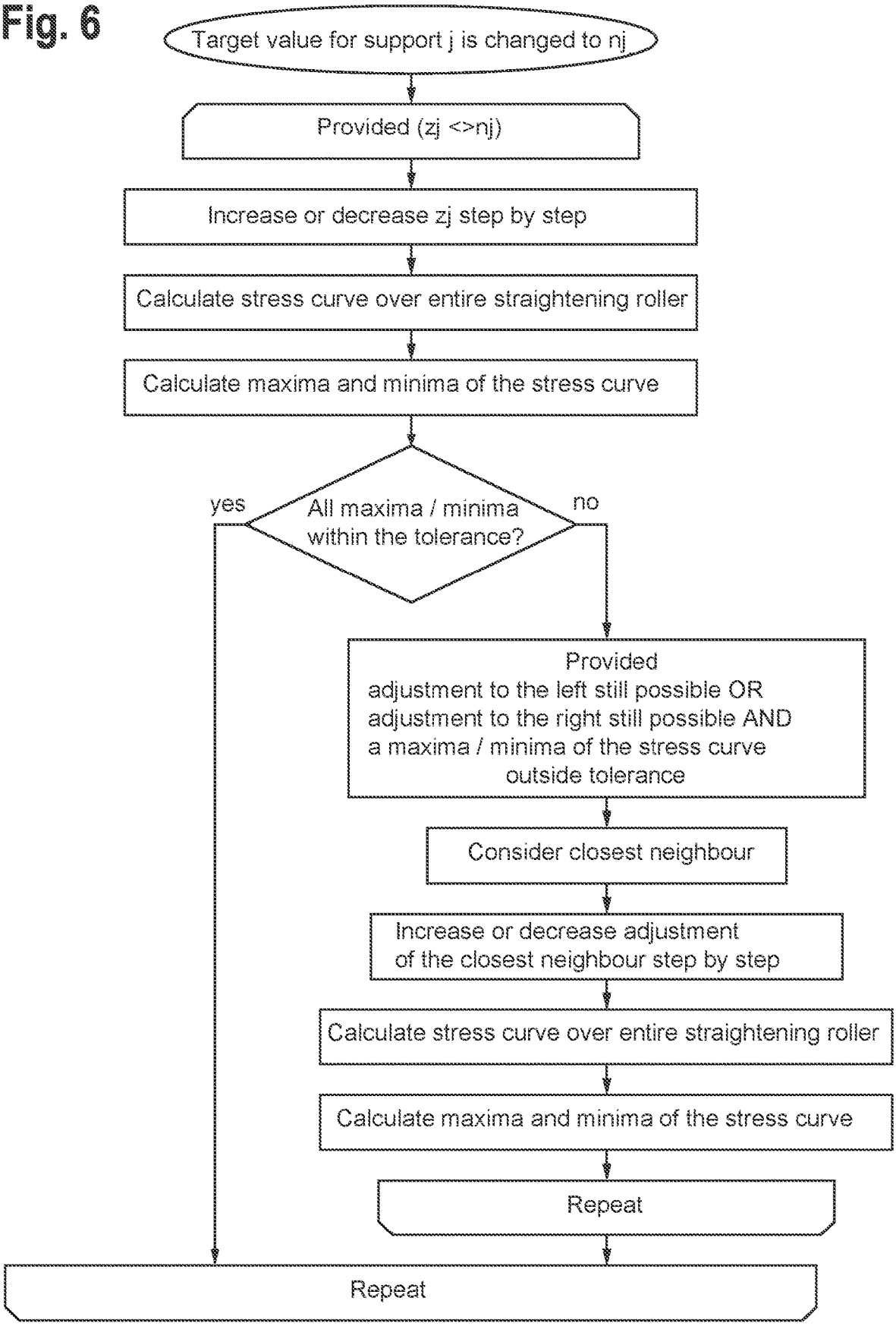
Figure 7:
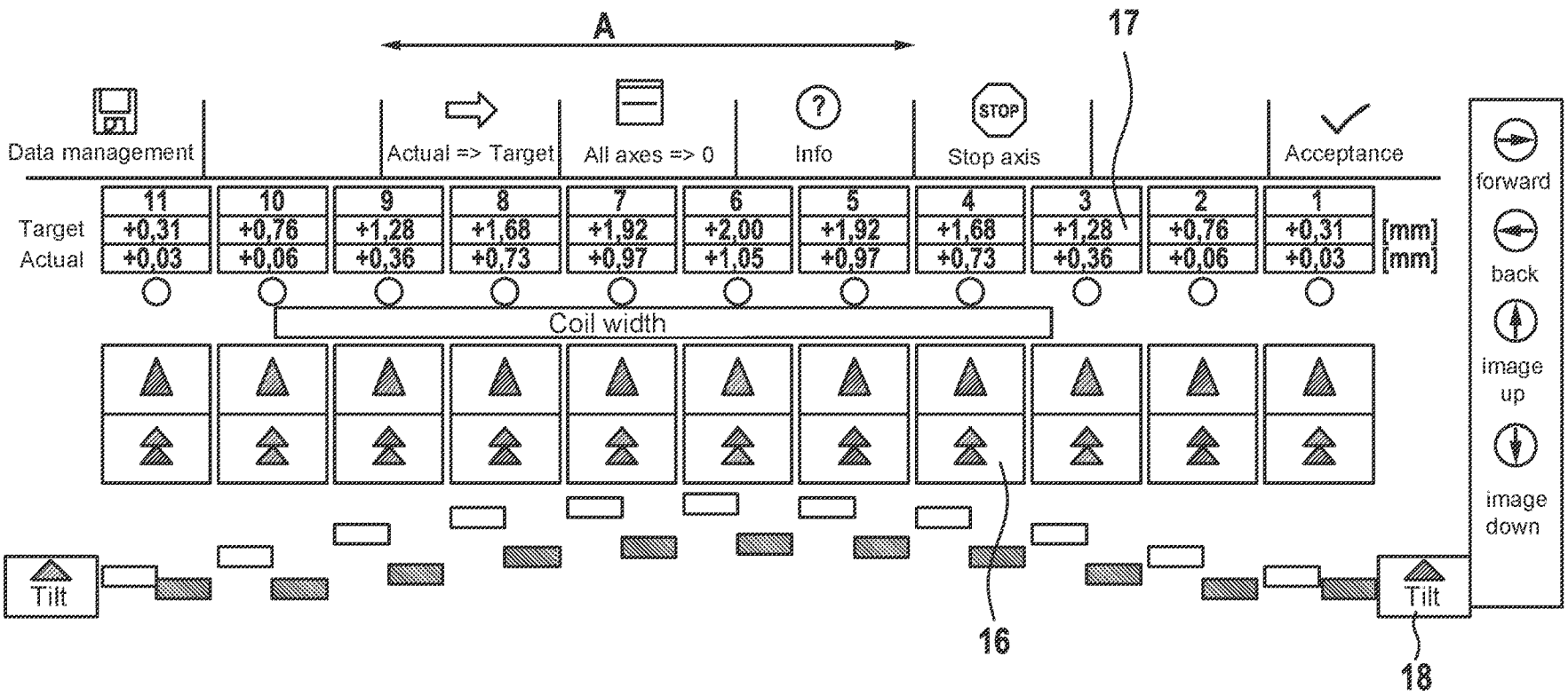
Figures 2, 8:
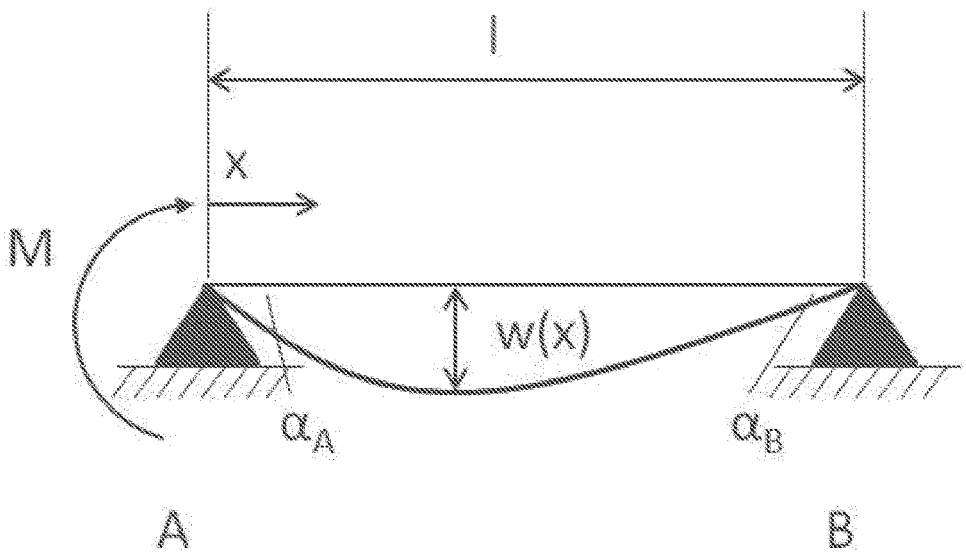
Figure 8:
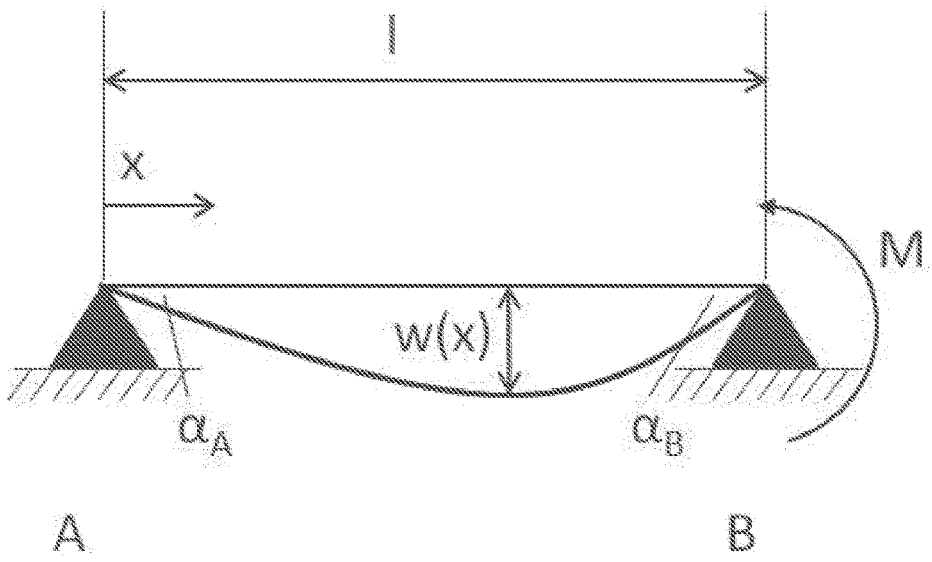
Figure 3:
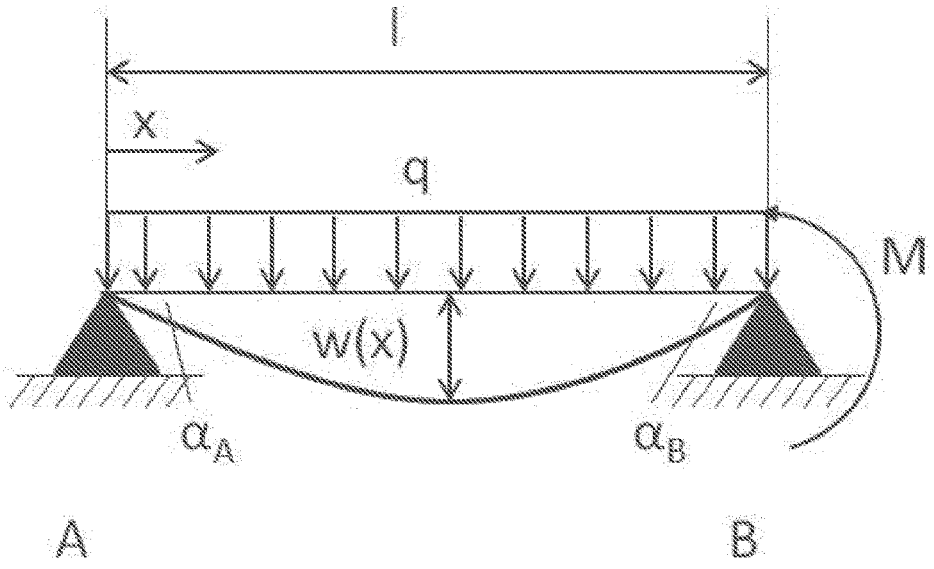

FIG. 3 shows a schematic, partial sectional view of the roller straightening machine according to FIG. 1, FIG. 4 shows a perspective view of an actuating device, FIG. 5 shows the stress profile of an actual stress curve and of a bending line over a width of a straightening roller, FIG. 6 shows a schematic flow diagram of a computer program product, FIG. 7 shows a display for operating the computer program product according to FIG. 6, and FIGS. 8-1 to 8-13 show deviations of the equations for the equilibriums of moments, the stresses in the straightening roller, and for superposition of the torsional stress.

The roller straightening machine shown in FIG. 1 has a lower roller mill 1 and an upper roller mill 2. Reference sign 3 denotes actuating drives by means of which lower straightening rollers (not shown), or rather straightening rollers of the lower roller mill 1 are adjustable. The arrow T denotes a transport direction of a sheet metal strip (not shown here) through a straightening gap formed between the lower mill 1 and the upper roller mill 2. The arrow A denotes an axial direction which runs parallel to the axes of the straightening rollers (not shown here). The arrow V denotes a vertical direction running perpendicularly to the transport direction T and to the axial direction A.

Figure 2:
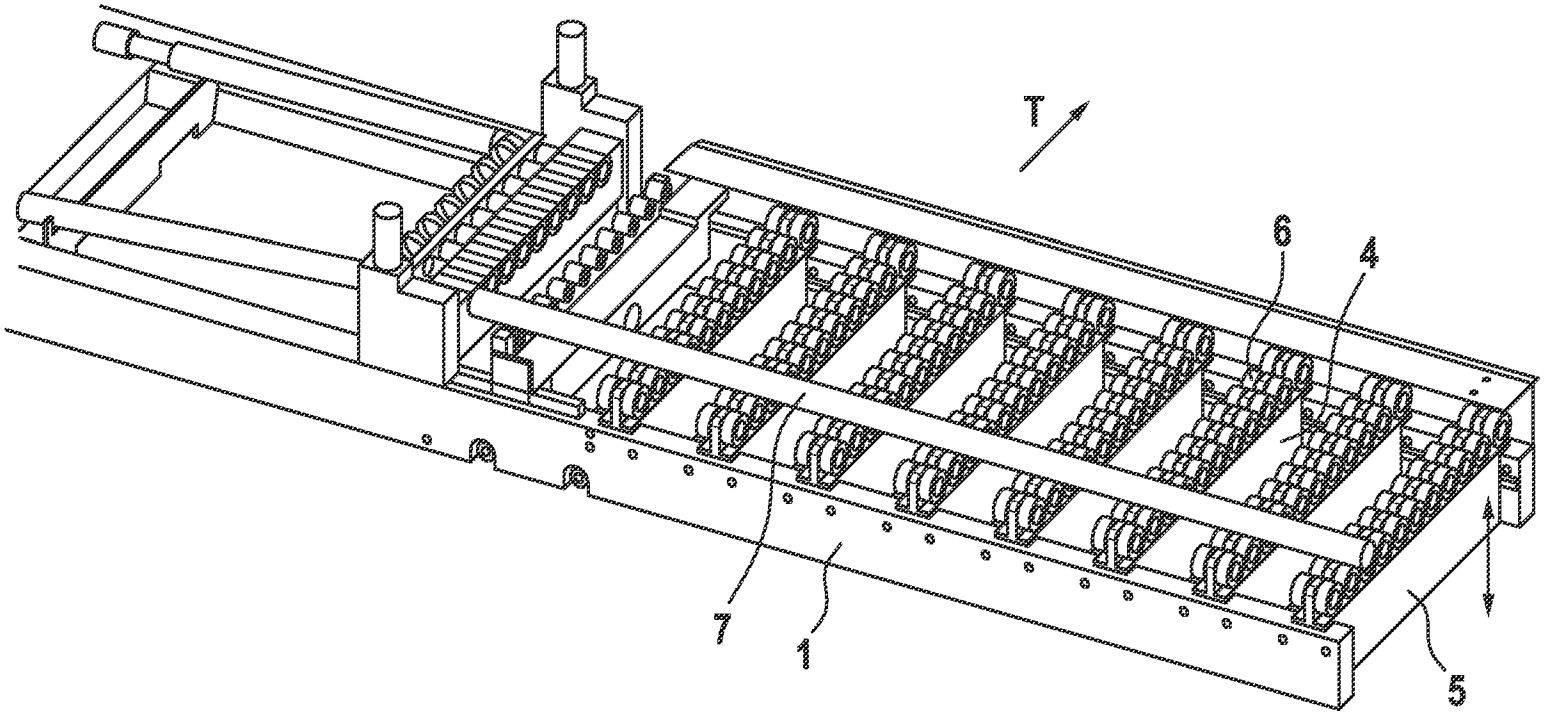
FIG. 2 shows a perspective view of a lower roller mill.

FIG. 2 shows a schematic view of the lower roller mill 1. Reference sign 4 denotes supporting roller devices which extend in the transport direction T. Each of the supporting roller devices 4 has a holding device 5, on which a plurality of supporting rollers 6 are received in pairs one behind the other in the transport direction T. Reference sign 7 denotes a lower straightening roller or a straightening roller. For the sake of clarity, merely one straightening roller 7 is shown here. Intermediate rollers, which are arranged between the supporting rollers 6 and the straightening roller 7, have also been omitted.

FIG. 3 shows a schematic sectional view through the lower roller mill 1 and the upper roller mill 2. The supporting rollers 6 received on the holding device 5 are movable in the lower roller mill 1 in the vertical direction V by means of an actuating device (not visible here). Reference sign 8 denotes intermediate rollers, which are supported on the supporting rollers 6. The lower straightening rollers 7 are in turn supported on the intermediate rollers 8.

The upper roller mill 2 comprises upper straightening rollers 9, which are arranged in the transport direction T offset from the lower straightening rollers 7. The upper straightening rollers 9 are supported via further intermediate rollers 10 on further supporting rollers 11. In the present exemplary embodiment the further supporting rollers 11 are not adjustable. Reference sign 12 denotes a straightening gap formed between the lower straightening rollers 7 and the upper straightening rollers 9.

FIG. 4 shows a schematic view of actuating devices 13 for moving holding devices 5 (not shown here) supported thereon in the vertical direction V. Each of the actuating devices 13 comprises an actuating drive 3, by means of which two lower wedges 14 are displaceable relative to one another. An upper double wedge 15, which performs a vertical movement when the distance between the lower wedges 14 changes, is supported on the lower wedges 14.

In FIG. 5, a calculated actual stress curve is shown by reference sign IS, which curve shows the profile of the stresses produced in a straightening roller 7, 9. In the present example the predefined limiting values stored in the control system are $vMA+1.5*10^8$ PA and $vMI-1.5*10^8$ Pa. The maxima MA and minima MI of the actual stress curve IS are given by the adjustment of an actuating device and/or the sheet metal guided through between the straightening rollers 7, 9. Under consideration of an elastic deformation resistance of the lower straightening roller 7, the bending line B shown in FIG. 5 is given by calculation from the actual stress curve IS. If the actual stress curve IS changes, this being brought about for example by adjustment of one of the actuating devices 13, the bending line B changes.

An upper limiting value vMA and a lower limiting value vMI are stored in the computer program of the control system. If a minimum MI or a maximum MA of the actual stress curve lies outside the limiting values vMA, vMI, an adjustment of further actuating devices 13 is changed iteratively until the predefined limiting values vMA, vMI are complied with.

The method according to the invention will now be explained in greater detail with reference to the flow diagram in FIG. 6:

At the start of the method, a manual change is made to an adjustment of one of the supporting roll devices 4. Such a manual adjustment is performed by an operator, for example if a planarity error is observed in the sheet metal strip running out from the roller straightening machine. As a result of the change to the adjustment nj, the current actual stress curve is calculated over the width of the straightening roller. The maxima MA and the minima MI of the current actual stress curve IS are then calculated. If all maxima MA and minima MI are within the predefined limiting values vMA, vMI, the routine is ended.

If a maximum MA or a minimum MI are not within the predefined limiting values vMA, vMI, the adjustment is firstly changed step-by-step in accordance with the algorithm in a directly adjacent actuating device, and the current actual stress curve over the straightening roller is then calculated. The maxima MA and minima MI of the actual stress curve are then, in turn, calculated, and by repeating the routine it is checked whether they lie within the upper limiting value vMA and the lower limiting value vMI. If this is not the case, the routine is repeated for all further adjacent actuating devices until the predefined upper limiting value vMA and the lower limiting value vMI are complied with.

Although in the above exemplary embodiment the method according to the invention has been explained with use of a calculated actual stress curve, it is also possible to omit the calculation of such an actual stress curve. In order to carry out the method according to the invention, a calculation of the current maxima MA and minima MI as well as a comparison of the current maxima MA and minima MI with the predefined upper vMA and lower limiting value vMI are sufficient.

FIG. 7 shows a display operating the computer program according to FIG. 6. Each supporting roller device 4 is assigned 2 first buttons 16. By actuating one of the first buttons 16, an adjustment of the corresponding supporting roller device 4 may be increased. The resultant target and actual values of the adjustment may be deduced from a display field 17 arranged above. The target and actual values are shown graphically once more below the first buttons 16. Next to the graphical representation of the target and actual values, there are two "tilt" buttons 18. By actuating the second buttons 18, actuating devices 4 may be adjusted in accordance with a "tilt" adjustment mode provided in the algorithm such that the width of the straightening gap 12 over the axial direction A is changed in some sections. In principle, the method explained in FIG. 6 may also be carried out in the "tilt" adjustment mode, i.e. in this case too there is an iterative adjustment of the actuating devices 4 in such a way that the resultant maxima MA and minima MI are kept within the predefined upper limiting value vMA and lower limiting value vMI.

Although it is not shown in FIG. 7, further first buttons are provided in the display below the graphical presentation of the target and actual positions and may be used to decrease an adjustment of the actuating devices 4. The further first buttons have been left out for the sake of clarity. They correspond to the first buttons 16 in respect of their design, although the direction arrows are reversed.

FIGS. 8-1 to 8-13 show deviations of the equations for the equilibriums of moments. The equation systems 1 to 11 shows the equations for the equilibriums of moments.

The advantageous consideration of the torsional stresses of the straightening rollers is shown after the equation system 1 to 11. The abbreviation "GEH" means "design modification hypothesis".

LIST OF REFERENCE SIGNS

1 lower roller mill
2 upper roller mill
3 actuating drive
4 actuating device
5 holding device
6 supporting roller
7 (lower) straightening roller
8 intermediate roller
9 upper straightening roller
10 further intermediate roller
11 further supporting roller
12 straightening gap
13 actuating device
14 lower wedge
15 upper double wedge
16 first button
17 display field
18 second button
A axial direction
B bending line
IS actual stress curve
MA maximum
MI minimum
T transport direction
V vertical direction
vMA upper limiting value
vMI lower limiting value

The invention claimed is:

1. A method for adjusting a roller straightening machine, comprising:

arranging lower straightening rollers to be spaced apart from each other in a transport direction, lower supporting rollers situated under the lower straightening rollers, and actuating devices for adjusting the lower supporting rollers such that stresses are produced in the lower straightening rollers, arranging upper straightening rollers to be spaced apart from each other in the transport direction above the lower straightening rollers, and upper supporting rollers situated above the upper straightening rollers, adjusting and controlling the lower supporting rollers by the actuating devices such that stresses are produced in the lower straightening rollers, storing in a control system limiting values (vMA, vMI) with respect to the stresses produced in the lower straightening rollers, actuating the lower supporting rollers to obtain an actual stress curve showing a profile of stresses produced by the upper and lower straightening rollers under an elastic deformation resistance of the upper and lower straightening rollers, calculating an actual bending line from the actual stress curve under consideration of the elastic deformation resistance of the upper and lower straightening rollers, and running the lower supporting rollers within the limiting values (vMA, vMI), wherein, in an event of a change in an adjustment of one of the lower supporting rollers, maxima (MA) and minima (MI) of the stresses produced in the lower straightening rollers are calculated and it is checked whether the maxima (MA) and minima (MI) lie within the limiting values (vMA, vMI) and, if this is not the case, a further adjustment of at least one of the supporting rollers is changed automatically in accordance with a predefined algorism stored in the control system such that the stresses produced in the straightening rollers remain within the limiting values (vMA, vMI).

2. The method according to claim 1, wherein torsional stresses brought about by a drive of the upper and lower straightening rollers are superposed in order to calculate the stresses.

3. The method according to claim 1, wherein each of the actuating devices comprises two wedges displaceable relative to one another, on which a holding device receiving each of the lower supporting rollers is supported, and wherein a change to the adjustment is brought about by a displacement of at least one of the wedges relative to the holding device.

4. The method according to claim 1, wherein each of the lower straightening rollers is supported on the supporting rollers with two intermediate rollers arranged in between.

5. The method according to claim 1, wherein the lower supporting rollers include intermediate rollers disposed between the lower supporting rollers and the lower straightening rollers.

6. The method according to claim 1, wherein the maxima (MA) and minima (MI) of the actual stress curve are stored in the control system and are given for an adjustment of the actuating devices and/or a sheet metal guided between the upper and lower straightening rollers.

7. The method according to claim 1, wherein the lower straightening rollers have a cylindrical shape and are arranged perpendicular to the transport direction, and the upper straightening rollers have a cylindrical shape and are arranged perpendicular to the transport direction.

8. The method according to claim 1, wherein the lower straightening rollers are cambered by the actuating devices, while the upper straightening rollers are not cambered.

9. A computer program product for adjusting bending of at least one straightening roller of a roller straightening machine, comprising: computer instructions for carrying out the method of claim 1 stored on a computer-readable storage medium which, when executed, prompt the control system to carry out the computer instructions on the roller straightening machine.

* * * * *